US007267096B2

(12) United States Patent
Boecking

(10) Patent No.: US 7,267,096 B2
(45) Date of Patent: Sep. 11, 2007

(54) FUEL INJECTION DEVICE FOR AN INTERNAL COMBUSTION ENGINE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/531,174

(22) PCT Filed: May 23, 2003

(86) PCT No.: PCT/DE03/01677

§ 371 (c)(1),
(2), (4) Date: Dec. 16, 2005

(87) PCT Pub. No.: WO2004/033891

PCT Pub. Date: Apr. 22, 2004

(65) Prior Publication Data

US 2006/0144964 A1 Jul. 6, 2006

(30) Foreign Application Priority Data

Oct. 9, 2002 (DE) ..... 102 46 973

(51) Int. Cl.
*F02B 3/00* (2006.01)
*F02B 3/04* (2006.01)

(52) U.S. Cl. ..... 123/299; 123/467

(58) Field of Classification Search ..... 123/299, 123/300, 305, 467, 468; 239/96, 533.2, 533.3, 239/533.4, 533.12
See application file for complete search history.

(56) References Cited

U.S. PATENT DOCUMENTS

| | | | | |
|---|---|---|---|---|
| 6,378,503 | B1 * | 4/2002 | Lambert | 123/468 |
| 6,471,142 | B1 * | 10/2002 | Lambert | 239/88 |
| 6,557,776 | B2 * | 5/2003 | Carroll et al. | 239/5 |
| 6,705,543 | B2 * | 3/2004 | Carroll et al. | 239/96 |
| 2003/0015599 | A1 * | 1/2003 | Carroll et al. | 239/88 |
| 2003/0038185 | A1 * | 2/2003 | Carrol et al. | 239/96 |
| 2003/0066509 | A1 * | 4/2003 | Shafer et al | 123/305 |
| 2006/0060673 | A1 * | 3/2006 | Mack et al. | 239/533.2 |

FOREIGN PATENT DOCUMENTS

| | | |
|---|---|---|
| DE | 100 58 153 A1 | 6/2002 |
| EP | 1 069 308 A2 | 1/2001 |
| WO | WO 02/42637 A1 | 5/2002 |

* cited by examiner

*Primary Examiner*—Mahmoud Gimie
(74) *Attorney, Agent, or Firm*—Ronald E. Greigg

(57) ABSTRACT

A fuel injection device for an internal combustion engine has a housing that contains a recess, which in turn contains two valve elements that are disposed coaxial to each other and each cooperating with a corresponding valve seat and are each associated with corresponding fuel outlet openings. In order for the fuel injection device to be as compact as possible, a shared valve device provided, which has at least three switched positions and influences the position of the valve elements.

20 Claims, 3 Drawing Sheets

FUEL INJECTION DEVICE FOR AN INTERNAL COMBUSTION ENGINE

CROSS-REFERENCE TO RELATED APPLICATIONS

This application is a 35 USC 371 application of PCT/DE 03/01677 filed on May 23, 2003.

BACKGROUND OF THE INVENTION

1. Field of the Invention

The invention relates to a fuel injection device for an internal combustion engine, with a housing, with a recess provided in the housing, and with at least two valve elements disposed coaxial to each other in the recess, which each cooperate with a corresponding valve seat and are each associated with a corresponding fuel outlet opening.

2. Description of the Prior Art

A fuel injection device of the type with which this invention is concerned is known from DE 40 23 223 A1, which has disclosed a fuel injector for internal combustion in which two valve needles are disposed coaxial to each other. The two valve needles each have a pressure surface which delimits a pressure chamber that is connected to a respective flow conduit through which fuel can flow to the pressure chamber. The pressure surfaces are oriented in such a way that when they are subjected to pressure, the valve needles lift away from their respectively associated seats, thus unblocking corresponding outlet openings at the end of the injector. The valve needles can be triggered independently of each other via the two flow conduits, which are independent of each other.

The object of the current invention is to modify a fuel injection device for an internal combustion engine of the type mentioned at beginning so that it is as simple and compact as possible.

This object is attained with a fuel injection device of the type mentioned at the beginning in that a shared valve device is provided, which has at least three switched positions and influences the position of the valve elements.

SUMMARY AND ADVANTAGES OF THE INVENTION

For operation, the fuel injection device according to the invention requires only one shared valve device that can trigger all of the valve elements at least indirectly. The fuel injection device is therefore relatively compact. Since a comparatively small number of parts is required, it is also inexpensive to produce. The fact that the shared valve device provided according to the invention has three switched positions affords a high degree of flexibility in the operation of the fuel injection device according to the invention.

Advantageous modifications of the invention are disclosed. In a first modification the invention proposes that in a first switched position of the shared valve device, both valve elements rest against their respective valve seats, in a second switched position, one of the two valve elements is lifted away from its valve seat, and in a third switched position, both valve elements are lifted away from their valve seats.

In this case, the shared valve device covers all of the essential switching states of a fuel injection device with two valve elements. The fuel injection device is therefore compact on the one hand and on the other hand, permits an optimal operation of the engine in terms of emissions and fuel consumption.

It is particularly preferable if the shared valve device is a 3/3-way valve, which is connected to a low-pressure connection, a control chamber of the first valve element, and a control chamber of a hydraulically switchable valve device, which is in turn connected to a control chamber of a valve element and a high-pressure connection. The use of a hydraulically switchable valve device whose switched position is influenced by the shared valve device makes it possible to produce high fuel pressures without requiring the shared valve device to be particularly complex and/or expensive. At the same time, low levels of leakage are achieved inside the fuel injection device.

It is also preferable for a flow throttle to be disposed in the flow path between the high-pressure connection and the control chamber of the hydraulically switchable valve device. This makes it possible to influence the closing characteristic curve of the hydraulically switchable valve device and consequently also the closing characteristic curve of the second valve element.

Analogously to this, it is also preferable for a flow throttle to be disposed in the flow path between the control chamber of the hydraulically switchable valve device and the shared valve device. This influences the opening characteristic curve of the hydraulically switchable valve device and consequently also the opening characteristic curve of the second valve element. Above all, this also makes it possible to optimize the combustion noise of the engine.

It is also optimal if the one valve element operates in a pressure-controlled fashion and the other valve element operates in a stroke-controlled fashion. In this case, the respective advantages of pressure-controlled and stroke-controlled valve elements can be combined into a single fuel injection device. For example, a pressure-controlled valve element has a particularly advantageous injection characteristic curve in a partial load range of the engine.

The triggering of the pressure-controlled valve element is simplified in that the pressure-controlled valve element is disposed radially to the outside of the stroke-controlled valve element.

In a modification of this, it is also advantageous if the control chamber of the pressure-controlled valve element is connected to the hydraulically switchable valve device.

The advantages of the hydraulically switchable valve device in terms of low leakage levels at a simultaneously high pressure are particularly significant in connection with the triggering of a pressure-controlled valve element.

In another embodiment of the fuel injection device, it is also preferable if, in an end position of the shared valve device, the control chamber of the stroke-controlled valve element and the control chamber of the hydraulically switchable valve device are only connected to the high-pressure connection. In this switched position of the shared valve device, both valve elements are in their closed positions, i.e. in contact with their respective valve seats.

BRIEF DESCRIPTION OF THE DRAWINGS

A particularly preferable exemplary embodiment of the present invention will be explained in detail below in conjunction with the accompanying drawings, in which.

DESCRIPTION OF THE PREFERRED EMBODIMENT

Figure 1:
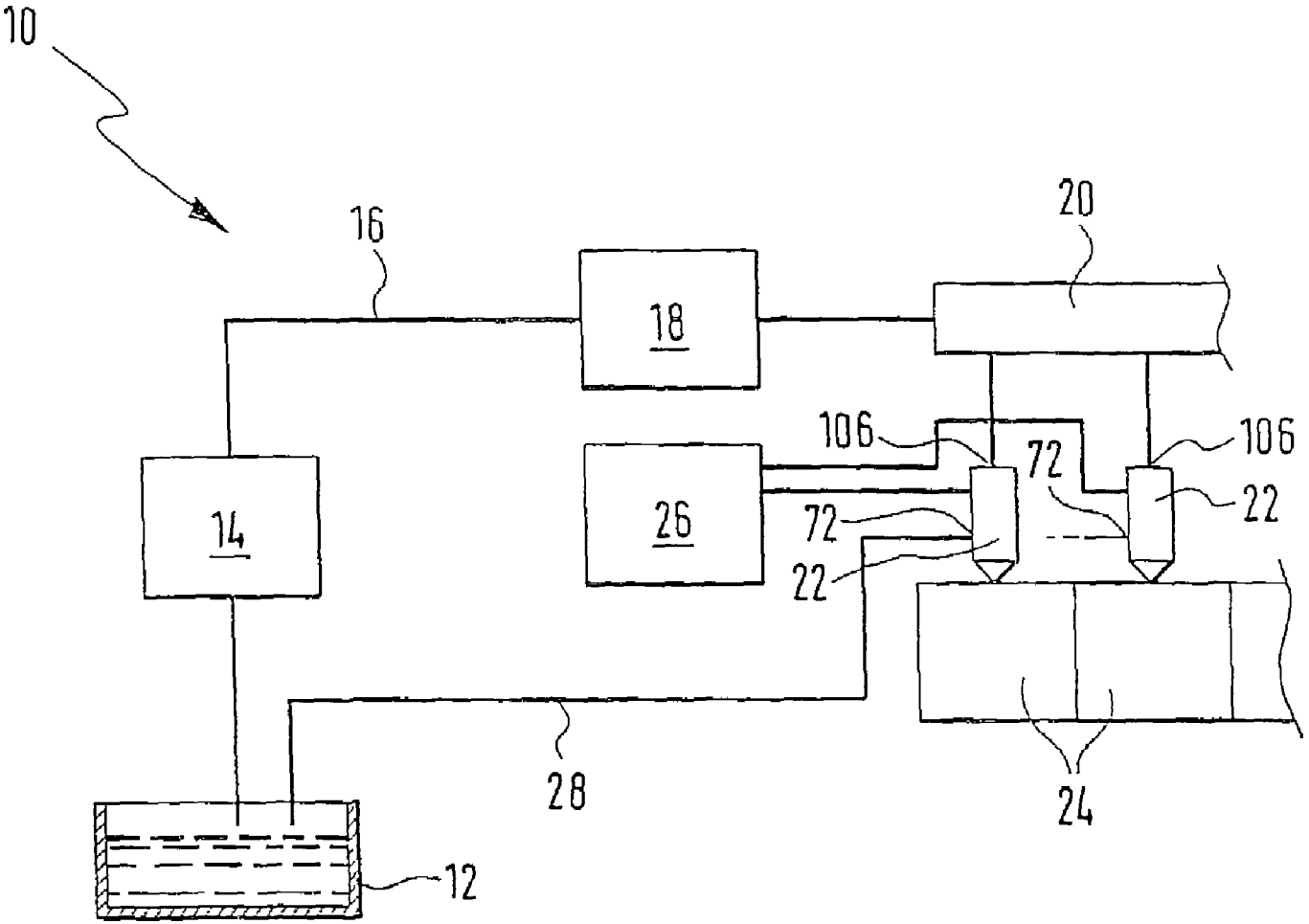
FIG. 1 is a schematic depiction of a fuel system of an internal combustion engine with a number of fuel injection devices.

In FIG. 1, a fuel system is labeled as a whole with the reference numeral 10. It includes a fuel tank 12, from which an electric fuel pump 14 supplies the fuel into a low-pressure fuel line 16. The low-pressure fuel line 16 leads to a high-pressure fuel pump 18. This high-pressure fuel pump 18 is a piston pump, which is driven by a camshaft (not shown) of the internal combustion engine to which the fuel system 10 belongs. The high-pressure fuel pump 18 feeds into a fuel accumulator 20 ("rail") in which the fuel is stored at high pressure.

The high-pressure accumulator 20 is connected to a number of injectors 22 that inject the fuel directly into associated combustion chambers 24 of the engine. The operation of the engine and the fuel system 10 is controlled and regulated by a control and regulating unit 26. In particular, the control and regulating unit 26 also triggers the injectors 22. A line 28 leads back to the fuel tank 12 from each of the injectors 22.

Figure 2:
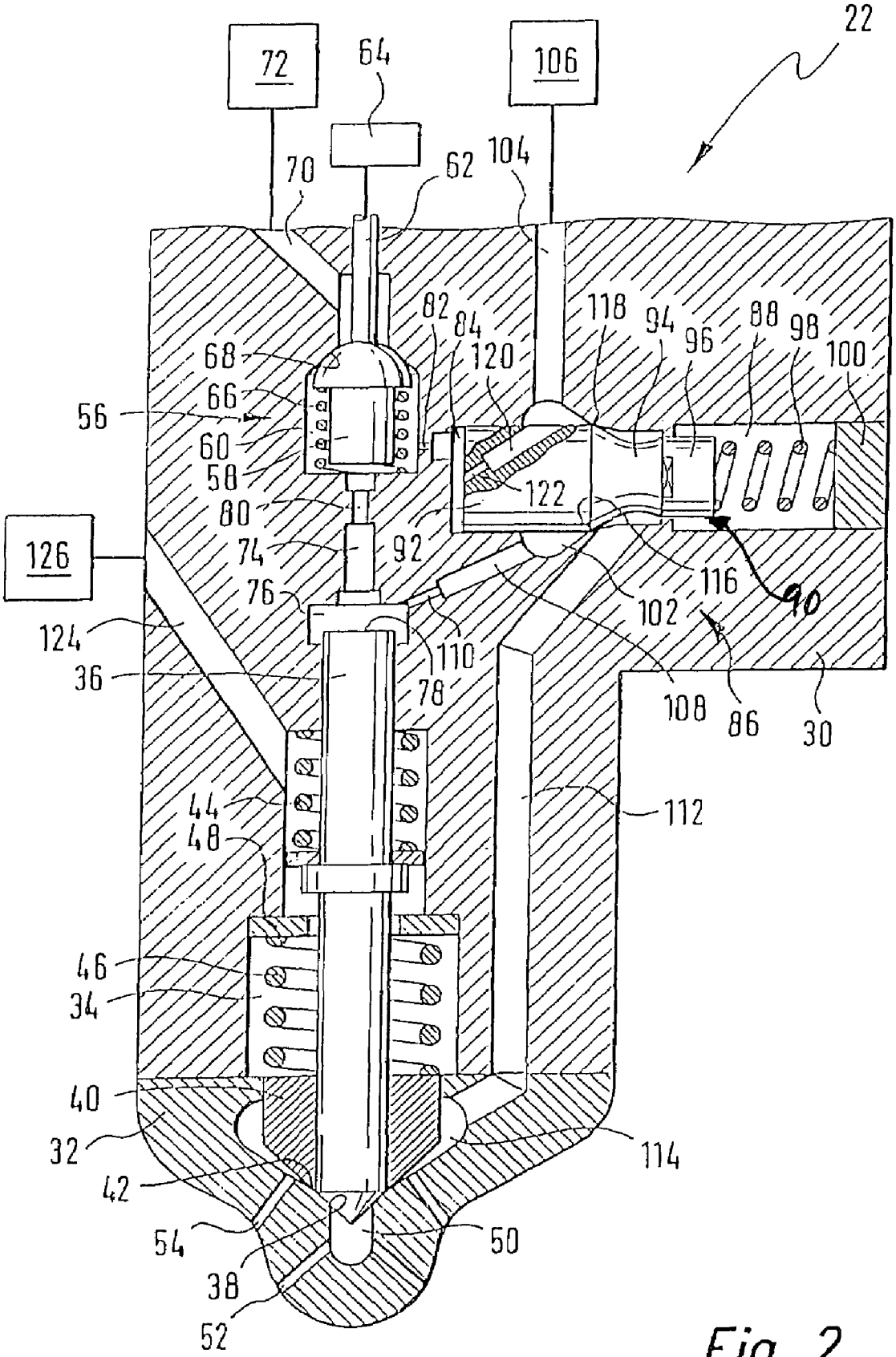
FIG. 2 is a partial section through one of the fuel injection devices from FIG. 1.

FIG. 2 shows a detailed view of a region of one of the injectors 22 which has a two-part housing with an upper part 30 and a lower part 32. The housing 30, 32 contains a recess 34, which in turn contains a first elongated valve element 36, among other things. Its lower end in FIG. 2 tapers conically to a point and cooperates with a valve seat 38 (see FIG. 3) in the lower part 32 of the housing. Coaxial to the first valve element 36 and radially outside it, a second valve element 40 is provided, whose likewise conical tip cooperates with a valve seat 42 in the lower part 32 of the housing.

A compression spring 44, whose one end rests against a shoulder (unnumbered) in the upper part 30 of the housing, acts on the first valve element 36 in the direction toward the valve seat 38. Analogously, a compression spring 46 acts on the second valve element 40 in the direction of the corresponding valve seat 42. The compression spring 46 does not rest directly against a shoulder in the recess 34 in the upper part 30 of the housing, but against an intermediate ring 48.

The recess 34 in the bottom part 32 of the housing includes a blind hole 50 from which a number of outlet openings 52 lead outward. The fuel, as will be explained in more detail below, flows out through these outlet openings 52 when the first valve element 36 and second valve element 40 are open. Analogously, outlet openings 54 allow fuel to flow out when only the second valve element 40 has lifted away from the valve seat 42. This, too, will be described in more detail below.

A shared valve device 56, which is disposed in the upper region of the upper part 34 of the housing, is provided for actuating the two valve elements 36 and 40. It includes a hemispherical valve element 58, which is contained in a switch chamber 60. A piezolelectric actuator 64 that is depicted only symbolically here can move the valve element 60 into various switched positions by means of a tappet 62.

In the idle position, a compression spring 66 presses the valve element 58 against a valve seat 68. When the valve element 58 rests against the valve seat 68, this interrupts the connection from the switch chamber 60 to a low-pressure connection 72 via a conduit 70 (also see FIG. 1). The low-pressure connection 72 is in turn connected to the return line 28, which leads back to the fuel tank 12.

From the end wall of the switch chamber 60 at the bottom in FIG. 2, a conduit 74 leads to a control chamber 76. A pressure surface 78 at the upper end of the first valve element 36 in FIG. 2 also protrudes into the control chamber 76. The conduit 74 contains a flow throttle 80. From the radial boundary wall (unnumbered) of the switch chamber 60, a fluid connection (unnumbered) leads via a flow throttle 82 to a control chamber 84 of a hydraulically actuatable switch valve 86.

The hydraulically actuatable switch valve 86 also has a switch chamber 88 that contains a valve element 90. The valve element 90 is cylindrical on the whole, with a switching section 92 that has a circular cylindrical diameter, a transition section 94 that is embodied in the form of a constriction, and a circular cylindrical guide section 96. One end of a compression spring 98 rests against a connecting part 100. The other end of the compression spring 98 acts on the valve element 90 in the direction toward the control chamber 84.

An annular groove 102 is provided in the circumference wall of the switch chamber 88. On the one hand, this annular groove 102 is connected via a conduit 104 to a high-pressure connection 106 (also see FIG. 1), which in turn leads to the fuel accumulator 20. In addition, a conduit 108 leads from the annular groove 102 via a flow throttle 110 to the control chamber 76 that controls the movement of the first valve element 36. From the section of the circumference wall of the switch chamber 88, which is disposed approximately in the region of the constricted transition section 94 of the valve element 90, a conduit 112 leads to an annular chamber 114 in the lower region of the second valve element 40.

To the right of the annular groove 102 in FIG. 2, the circumference wall of the switch chamber 88 forms a valve seat 116 for a switching edge 118 of the valve element 90. The switching edge 118 is formed between the switching section 92 and the transition section 94. Inside the switching section 92 of the valve element 90, another conduit 120 extends diagonal to the longitudinal axis of the valve element 90. This additional conduit 120 has a flow throttle 122 and connects the annular groove 102 to the control chamber 84. There is also a leakage conduit 124 that leads from the recess 34 in the upper part 30 of the housing to a leakage connection 126.

Figure 3:
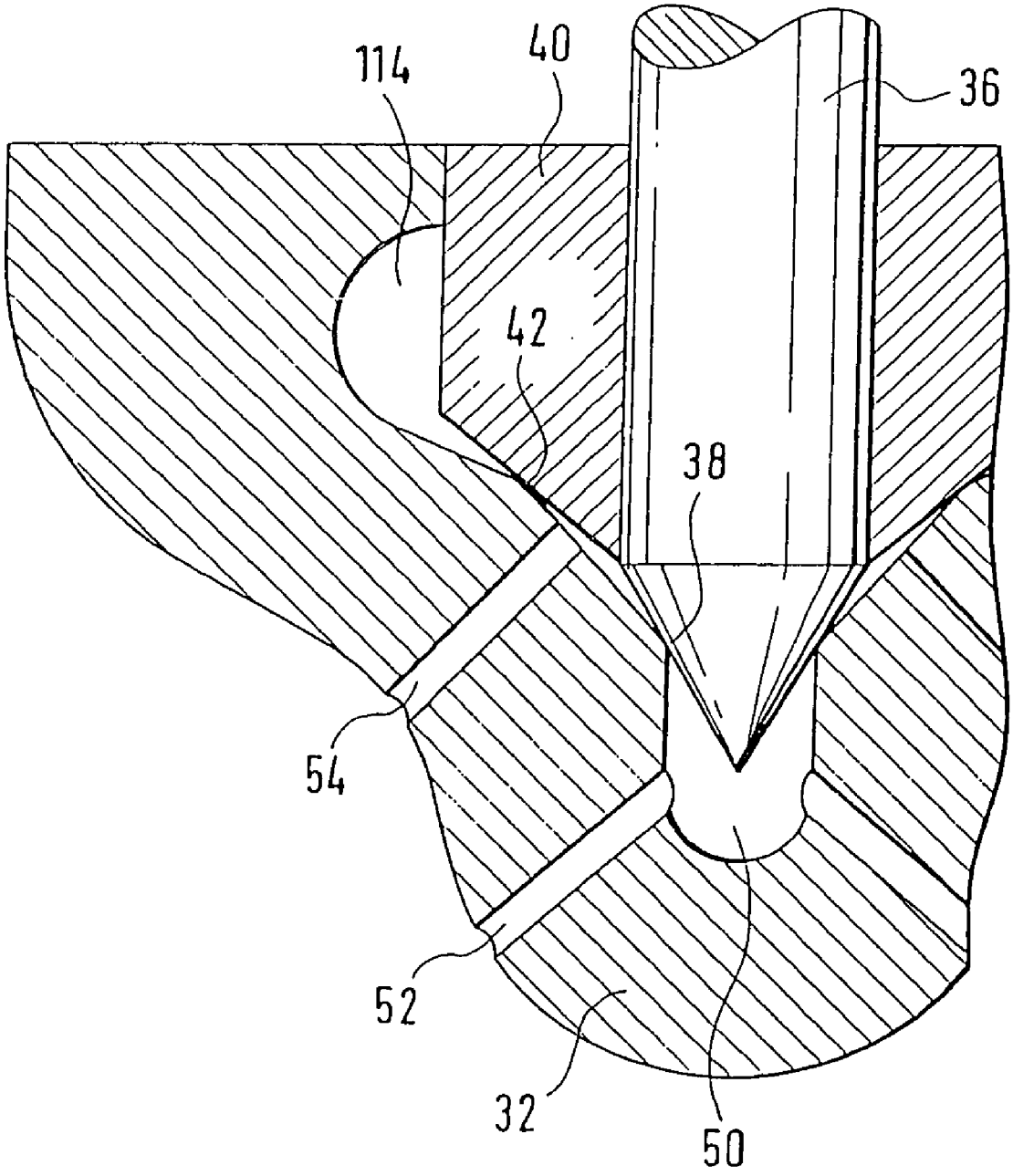
FIG. 3 is an enlarged depiction of a region of the fuel injection device from FIG. 2.

The injector 22 shown in FIGS. 1 to 3 operates in the following way:

In the first idle position, the valve element 58 of the shared valve device 56 rests against the valve seat 68 at the top in FIG. 2. Consequently, the high-pressure prevailing in the high-pressure connection 106 also prevails in the switch chamber 60 of the shared valve device 56, in the control chamber 76 of the first valve element 36, and in the control chamber 84 of the hydraulically actuated switch valve 86. As a result of this, the valve element 92 of the hydraulically actuated switch valve 86 is pressed with its switching edge 118 against the valve seat 116. The region of the switch chamber 88 that coincides with the transition region 94 is thus disconnected from the high-pressure connection 106 and a comparatively low pressure prevails in it. The same is true for the conduit 112 and the annular chamber 114. It is therefore possible for the spring 46 to press the second valve element 40 against the valve seat 42.

Because a high pressure prevails in the control chamber 76 and therefore also against the pressure surface 78, but a low pressure (combustion chamber pressure) simultaneously prevails in the blind hole 50, the valve element 36 is also pressed against the valve seat 38. In this first switched position of the shared valve device 56, in which the valve element 58 rests against the valve seat 68, the injector 22 is therefore closed and no fuel flows out of the outlet openings 52 and 54.

By means of the tappet 62, the actuator 64 can move the valve element 58 of the shared valve device 56 into a second switched position in which it rests against the boundary wall of the switch chamber 60 at the bottom in FIG. 2. Then the switch chamber 60 is connected to the low-pressure connection 72 via the conduit 70. As a result, the high pressure can escape from the pressure chamber 84 of the hydraulically actuatable switch valve 86 via the flow throttle 82. Then the compression spring 98 moves the valve element 90 of the hydraulically actuatable switch valve 86 toward the control chamber 84 so that the switching edge 118 lifts away from the valve seat 116.

The highly pressurized fuel in the annular groove 102 can then flow into the annular chamber 114 via the conduit 112. Then the high fuel pressure that prevails in the high-pressure connection 106 also prevails in a region of the conical end surface of the valve element 40 at the bottom in FIG. 2, radially outside the valve seat 42. This causes the second valve element 40 to move upward in opposition to the action of the compression spring 46 so that it lifts away from the valve seat 42. Consequently, the highly pressurized fuel in the annular chamber 114 can flow out through the outlet openings 54.

Since the valve element 58 of the shared valve device 56 closes the conduit 74 to the control chamber 76 in this second switched position, a high fuel pressure prevails in this control chamber 76 that presses the first valve element 36 toward the bottom in FIG. 2 by means of the pressure surface 78. Although a high fuel pressure now prevails against the region of the conical lower end surface of the valve 36 disposed radially outside the valve seat 38, the force resultant directed toward the bottom in FIG. 2 and generated by means of the pressure surface 78 continues to press the first element 36 against the valve seat 38. Therefore it is still not possible for any fuel to flow out of the outlet openings 52.

The flow throttle 80 slows down the flow of fuel out of the control chamber 76 so that even during the movement of the valve element 58 of the shared valve device 56 from the first switched position into the second switched position, the pressure in the control chamber 76 does not drop far enough for the valve element to lift away from the valve seat 38.

The actuator 64 can also move the valve element 58 of the shared valve device 56 into a third, middle switched position. In this position, it rests neither against the valve seat 68 nor against the switch chamber 60 end wall at the bottom in FIG. 2. Consequently, as in the second switched position, the switch chamber 60 is connected to the low-pressure connection 72. In addition, however, now the fuel can flow out of the control chamber 76 via the conduit 74 and the flow throttle 80 into the switch chamber 60, and from there, to the low-pressure connection 72. As a result, the pressure in the control chamber 76 drops to the point that the high pressure prevailing against the conical end surface disposed radially outside the valve seat 38 lifts the valve element 36 away from the valve seat 38. When the valve element 58 of the shared valve device 56 is disposed in the middle, third switched position, the injector 22 injects fuel through both the outlet openings 54 and the outlet openings 52.

The foregoing relates to preferred exemplary embodiments of the invention, it being understood that other variants and embodiments thereof are possible within the spirit and scope of the invention, the latter being defined by the appended claims.

The invention claimed is:

1. A fuel injection device (22) for an internal combustion engine, the injection device comprising a housing (30, 32), a recess (34) provided in the housing (30, 32), at least two valve elements (36, 40) disposed coaxial to each other in the recess (34), each of the valve elements cooperating with a corresponding valve seat (38, 42) and each being associated with at least one corresponding fuel outlet opening (52, 54), and a shared valve device (56) having at least three switched positions and being operable to influence the position of the valve elements (36, 40), wherein, in a first switched position of the shared valve device (56), both of the valve elements (36, 40) rest against its valve seat (38, 42), wherein in a second switched position, one of the two valve elements (40) is lifted away from its valve seat (42), and wherein in a third switched position, both of the valve elements (36, 40) are lifted away from their valve seats (38, 42).

2. The fuel injection device (22) according to claim 1, wherein the shared valve device includes a 3/3-way valve (56) connected to a low-pressure connection (72), a control chamber (76) of the first valve element (40), and to a control chamber (84) of a hydraulically switchable valve device (86), which hydraulically switchable valve device is in turn connected to a control chamber (114) of a valve element and to a high-pressure connection (106).

3. The fuel injection device (22) according to claim 2, further comprising a flow throttle (122) disposed in the flow path between the high-pressure connection (106) and the control chamber (84) of the hydraulically switchable valve device (86).

4. The fuel injection device (22) according to claim 2, wherein the control chamber (114) of the pressure-controlled valve element (40) is connected to the hydraulically switchable valve device (86).

5. The fuel injection device (22) according to claim 1, further comprising a flow throttle (82) disposed in the flow path between the control chamber (84) of the hydraulically switchable valve device (86) and the shared valve device (56).

6. The fuel injection device (22) according to claim 5, wherein the one valve element (40) functions in a pressure-controlled manner and the other valve element (36) functions in a stroke-controlled manner.

7. The fuel injection device (22) according to claim 6, wherein the pressure-controlled valve element (40) is disposed radially outside the stroke-controlled valve element (36).

8. The fuel injection device (22) according to claim 5, wherein the control chamber (114) of the pressure-controlled valve element (40) is connected to the hydraulically switchable valve device (86).

9. The fuel injection device (22) according to claim 1, wherein the one valve element (40) functions in a pressure-controlled manner and the other valve element (36) functions in a stroke-controlled manner.

10. The fuel injection device (22) according to claim 9, wherein the pressure-controlled valve element (40) is disposed radially outside the stroke-controlled valve element (36).

11. A fuel injection device (22) for an internal combustion engine, the injection device comprising a housing (30, 32), a recess (34) provided in the housing (30, 32), at least two valve elements (36, 40) disposed coaxial to each other in the recess (34), each of the valve elements cooperating with a corresponding valve seat (38, 42) and each being associated with at least one corresponding fuel outlet opening (52, 54), and a shared valve device (56) having at least three switched positions and being operable to influence the position of the valve elements (36, 40) wherein the shared valve device includes a 3/3-way valve (56) connected to a low-pressure connection (72), a control chamber (76) of the first valve element (40), and to a control chamber (84) of a hydraulically switchable valve device (86), which hydraulically switchable valve device is in turn connected to a control chamber (114) of a valve element and to a high-pressure connection (106).

12. The fuel injection device (22) according to claim 11, further comprising a flow throttle (122) disposed in the flow path between the high-pressure connection (106) and the control chamber (84) of the hydraulically switchable valve device (86).

13. The fuel injection device (22) according to claim 12, wherein the one valve element (40) functions in a pressure-controlled manner and the other valve element (36) functions in a stroke-controlled manner.

14. The fuel injection device (22) according to claim 13, wherein the pressure-controlled valve element (40) is disposed radially outside the stroke-controlled valve element (36).

15. The fuel injection device (22) according to claim 12, wherein the control chamber (114) of the pressure-controlled valve element (40) is connected to the hydraulically switchable valve device (86).

16. The fuel injection device (22) according to claim 11, wherein the one valve element (40) functions in a pressure-controlled manner and the other valve element (36) functions in a stroke-controlled manner.

17. The fuel injection device (22) according to claim 16, wherein the pressure-controlled valve element (40) is disposed radially outside the stroke-controlled valve element (36).

18. The fuel injection device (22) according to claim 11, wherein the control chamber (114) of the pressure-controlled valve element (40) is connected to the hydraulically switchable valve device (86).

19. The fuel injection device (22) according to claim 18, wherein, in an end position of the shared valve device (56), the control chamber (76) of the stroke-controlled valve element (36) and the control chamber (84) of the hydraulically switchable valve device (86) are connected to only the high-pressure connection (106).

20. The fuel injection device (22) according to claim 11, further comprising a flow throttle (82) disposed in the flow path between the control chamber (84) of the hydraulically switchable valve device (86) and the shared valve device (56).

* * * * *